United States Patent [19]

McClam

[11] 4,402,098

[45] Sep. 6, 1983

[54] FITTED AND DRAPED BED COVERING

[76] Inventor: Paule McClam, 1805 Winnie Dr., Apt. #2, Bellevue, Nebr. 68005

[21] Appl. No.: 306,308

[22] Filed: Sep. 28, 1981

[51] Int. Cl.[3] ..... A47G 9/00

[52] U.S. Cl. ..... 5/494; 5/499; 5/502

[58] Field of Search ..... 5/499–502, 5/482, 494, 485, 496–498

[56] References Cited

U.S. PATENT DOCUMENTS

| | | | |
|---|---|---|---|
| 3,245,348 | 6/1966 | DiAddario | 5/499 |
| 3,530,487 | 9/1970 | Beer | 5/500 |
| 4,021,869 | 5/1977 | Root | 5/485 |
| 4,266,308 | 5/1981 | Smatz | 5/499 |
| 4,304,018 | 12/1981 | McClam | 5/499 |

*Primary Examiner*—Alexander Grosz

*Attorney, Agent, or Firm*—Zarley, McKee, Thomte, Voorhees & Sease

[57] ABSTRACT

A bed covering includes a fitted side covering adapted to overlie the head end, foot end and both sides of a mattress. A top portion of the bed covering overlies the top surface of the mattress and is connected to the fitted side covering by a folded skirt portion which extends along the foot end and both sides of the mattress. The skirt portion is folded along a medial lower edge so as to present an interior layer fastened along its upper edge to the fitted side covering and an exterior layer fastened along its upper edge to the top portion. The fitted side covering both secures the bed covering onto a mattress and tends to properly position the top and skirt portions relative to the mattress for facilitating the making of the bed.

12 Claims, 7 Drawing Figures

FITTED AND DRAPED BED COVERING

BACKGROUND OF THE INVENTION

The present invention is directed to an improved bed covering which accommodates the entry and exit of a person from the bed and which greatly facilitates the making of the bed.

For many years, the practice and materials used in preparing a bed have remained substantially the same. Generally a mattress is provided with a fitted lower sheet, a tucked-in upper sheet, a blanket and a single piece bedspread which is draped over the bed and folded back at the front end to be doubled over the pillows to cover them as well.

Several problems are commonly experienced when sleeping in a bed having the conventional preparation. First, normal movements during sleeping often cause the bed covering to be loosened along the foot end or sides of the bed allowing drafts to enter below the bed coverings. If the conventional bed coverings do remain tucked in, they are necessarily rather binding.

Likewise, it is well known that the making of a bed having conventional bed coverings is a rather tedious task. These problems are resolved by the bed covering of the present invention.

A primary object of the invention therefore is to provide an improved bed covering.

Another object of the invention is to provide a bed covering which prevents drafts from entering between the mattress and bed covering along the foot end or sides of the mattress.

Another object is to provide an improved bed covering which is not binding to one sleeping on a mattress.

Another object is to provide an improved bed covering which is adapted to be fitted into a mattress thereby facilitating the proper positioning of the bed covering onto the mattress.

A further object is to provide an improved bed covering which greatly facilitates the making of a bed onto which the bed covering has been fitted.

Finally, another object is to provide an improved bed covering which is economical to manufacture, refined in appearance and efficient in use.

SUMMARY OF THE INVENTION

The improved bed covering of the present invention includes a fitted side covering adapted to overlie the head end, foot end and sides of a mattress with means for fitting the side covering onto the mattress. The bed covering further comprises a top portion adapted to overlie the top surface of a mattress and a skirt portion hanging over the foot end and both sides of the mattress. The skirt portion is folded along a medial lower edge so as to present interior and exterior upper edges which are connected respectively to the fitted side covering and top portion.

The top portion is thus easily raised or pushed toward the rear of the bed without resistance since the fabric of the folded skirt portion easily accommodates such movements without binding. Since the side covering is fitted onto the mattress, proper positioning of the bed covering is easily accomplished by simply laterally moving the top portion to a position wherein the shirt portion is even on both sides. The continuous fastening of the skirt portion to the fitted side covering prevents drafts from entering between the mattress and top portion regardless of movements of a person on the bed.

Finally, a dust ruffle may be connected to the side covering along the head end thereof for covering the pillows on a bed and providing an attractive finished appearance for the bed when made.

DESCRIPTION OF THE PREFERRED EMBODIMENTS

Figure 1:
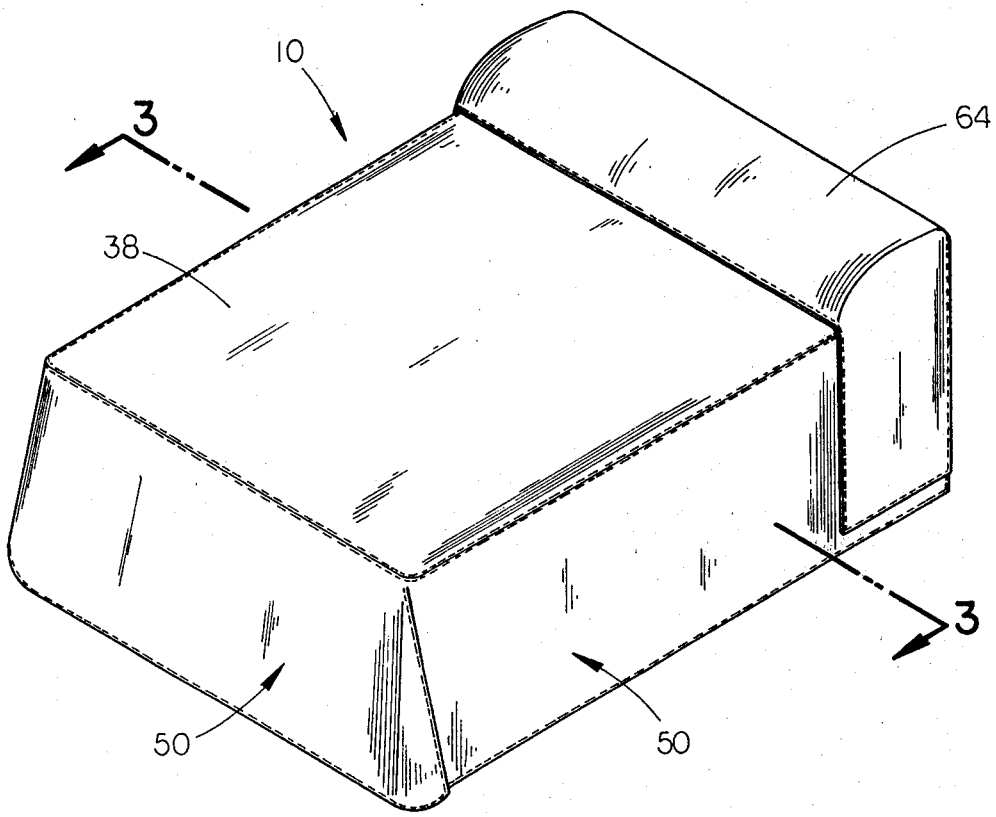
FIG. 1 is a perspective view of the bed covering positioned on a bed.

The bed covering 10 of the present invention is shown in FIG. 1 draped over a conventional bed including a mattress 12 (FIG. 2), a box spring 14 and a plurality of legs 16 or other frame means for supporting the box spring in clearance relation from the floor surface 18.

The mattress 12 has a head end 20, a foot end 22, opposite sides 24 and 26, a top surface 28 and a bottom surface, not shown.

Figure 2:
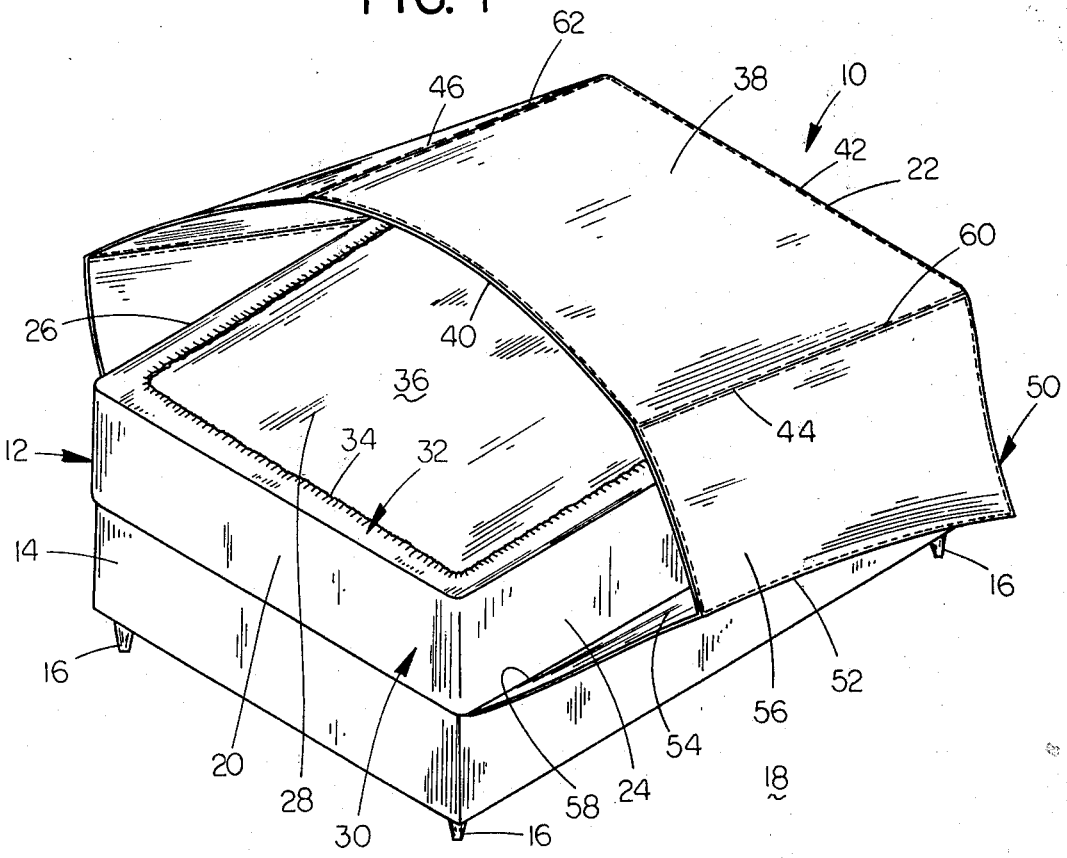
FIG. 2 is a perspective view showing the open forward end of the bed covering raised to show the internal construction thereof.

The bed covering 10 includes a fitted side covering 30, FIG. 2, which is adapted to overlie the head end 20, foot end 22 and sides 24 and 26 of mattress 12. A peripheral elasticized upper edge portion 32 and a similar lower edge portion, not shown, and tucked in along the top and bottom surfaces of the mattress for securely fitting the bed covering thereon.

The elasticized upper edge portion 32 defines a large central opening 34 which exposes the underlying sheet 36 or other bed linen on which one is supported when sleeping on the bed. The person is covered by a top portion 38 having a head edge 40, a foot edge 42 and opposite side edges 44 and 46. The top portion is connected to the fitted side covering 30 by a folded skirt portion 50 which extends along both sides and the foot end of the bed covering. Skirt portion 50 is a double layered piece of fabric folded along a medial lower edge 52 thereof so as to provide inner and outer layers 54 and 56 having interior and exterior upper edges 58 and 60 respectively.

Exterior upper edge 60 of skirt portion 50 is connected to the top portion 38 continuously along the foot edge 42 and both sides 44 and 46 thereof. In the preferred embodiment of FIGS. 1 and 2, the top portion 38 and skirt portion 50 are integrally formed from a single piece of fabric with no seam required for connecting them together. The stitching indicated at 62 which outlines the top portion is provided both for aesthetic effect and for facilitating the proper positioning of the bed covering onto a mattress.

Figure 3A:
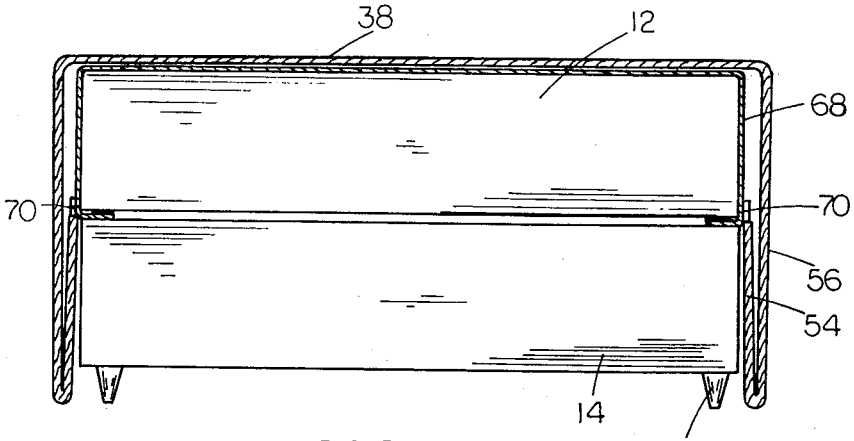
FIG. 3A is a sectional view, similar to FIG. 3 of an alternate embodiment without a hole in the top of the fitted side covering.
Figure 3C:
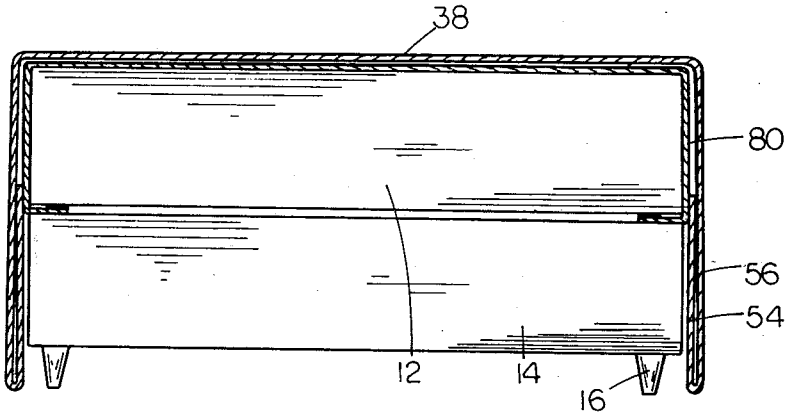
FIG. 3C is a sectional view of an alternate embodiment wherein the bed covering is integrally formed with a fitted sheet.
Figure 3:
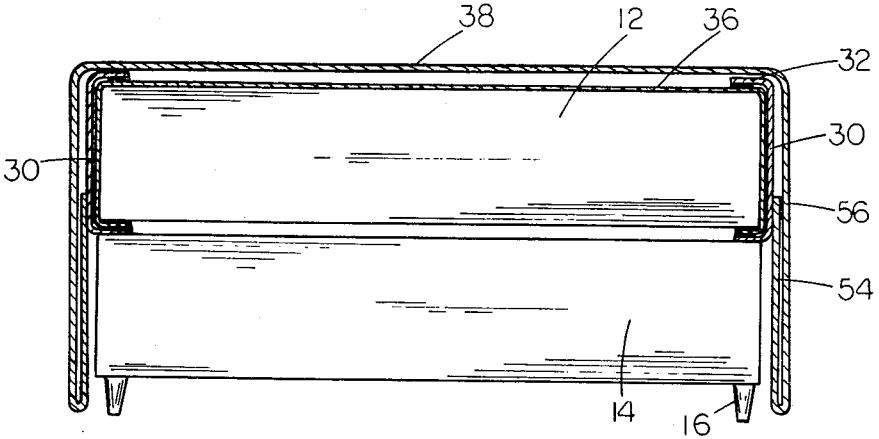
FIG. 3 is a sectional view showing the construction of the bed covering of FIG. 2.

The interior upper edge 58 of skirt portion 50 is connected to fitted side covering 30 continuously along the foot end and both sides thereof, preferably along a lower portion thereof as indicated in FIG. 3. Thus the inner layer 54 of skirt portion 50 hangs downwardly from the fitted side covering 30 and the folded outer layer 56 extends upwardly for connection to the top portion 38 which overlies the top surface of the mattress.

Thus it is seen in FIG. 2 that the top portion 38 can be easily raised up and down relative to the mattress and even moved back and forth and side to side to quite a substantial extent without binding. This is because the folded skirt portion 50 allows great freedom of movement of the top portion relative to the fitted side covering 30 and therefore greatly facilitates entry onto and exit from a bed equipped with the bed covering 10 of the present invention. At all times however the skirt remains continuously connected to both the top portion 38 and fitted side covering 30 so as to prevent drafts from entering between the top portion 38 and mattress, as often occurs when conventional bedding is disheveled particularly at the foot end of the bed.

The dust ruffle 64 shown in FIG. 1 as fastened by stitching to the fitted side covering 30 along the head end of the bed so as to be foldable rearwardly over a pair of pillows for providing an attractive finished appearance for the bed when made.

It should be understood that the dust ruffle is not critical to the present invention. In other embodiments the dust ruffle could be provided as a separate fabric piece not connected to the bed covering or the dust ruffle could be eliminated and replaced by attractive pillow cases.

Bed covering 10 improves sleeping conditions by eliminating drafts and providing sufficient covering for a number of people sleeping on the bed. The bed covering 10 also greatly facilitates the making of the bed. One need only apply a fitted sheet 36 (FIG. 3) onto mattress 12 and then fit the fitted side covering 30 of the present invention on the mattress over the fitted sheet. A simple up and down shake of the head edge 40 of top portion 38 will then cause the top portion and skirt portion 50 to properly drape over the mattress as shown in FIG. 1. The dust ruffle 64, which was omitted from FIG. 2 for clarity, then need only be turned back over the pillows and tucked in to complete the making of the bed as shown in FIG. 1.

Whereas a preferred embodiment of the invention has been shown and described herein, it will be apparent that many modifications, alterations and substitutions may be made which are within the intended broad scope of the appended claims. For example, referring to FIG. 3A, the fitted side covering may be provided as a complete fitted sheet 68 with the skirt portion 50 fastened to it continuously along the foot end and both sides by a zipper 70 or any other detachable fastening means.

Figure 3B:
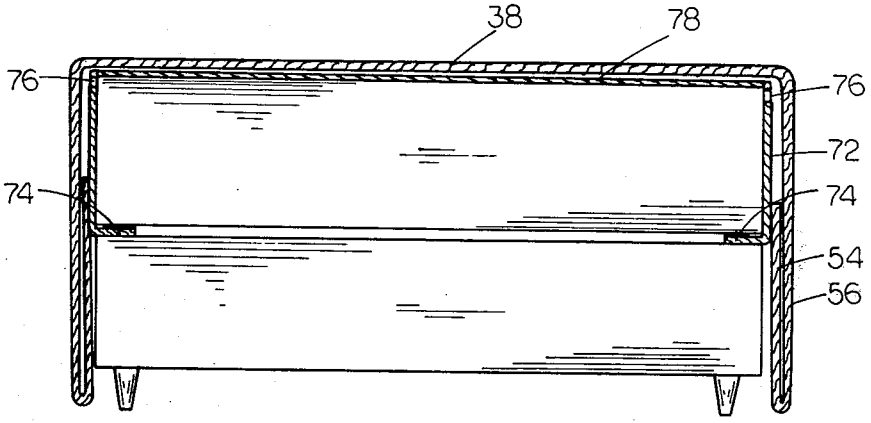
FIG. 3B is a sectional view of an alternate embodiment including a flat rectangular sheet having zippers around it for attachment to the fitted side covering.

Referring to FIG. 3B, the fitted side covering 72 may include an elasticized tuck portion 74 along the lower edge thereof and a zipper 76 or other such detachable fastening means along the upper edge thereof for connection to a rectangular flat sheet 78 by said zipper or other fastening means.

FIG. 3C shows another embodiment wherein the fitted side covering 80 also covers the top portion 38 of mattress 12 so as to present a single integral sheet and bed covering with no need for additional linen. This embodiment is particularly suited for a light summer bed covering and can be easily removed, washed and replaced on the bed.

Figure 3D:
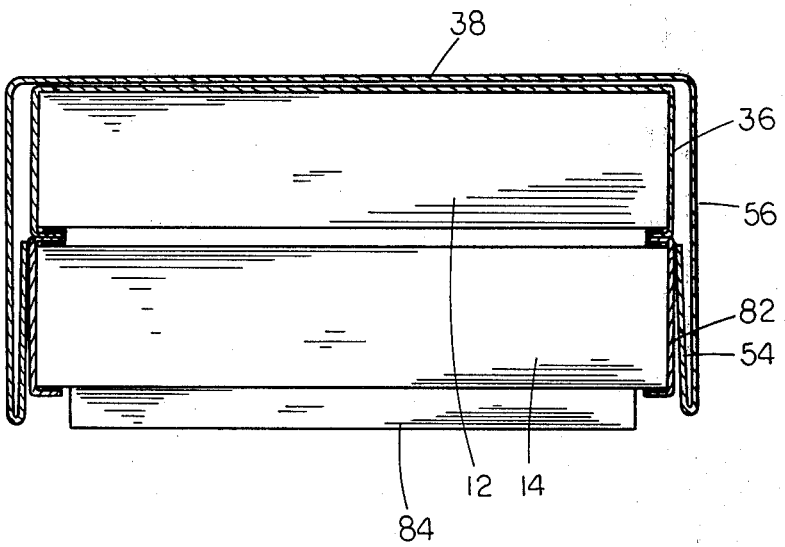
FIG. 3D is a sectional view of an alternate embodiment showing the side covering fitted onto the box spring of a bed.

Whereas many further embodiments are possible, FIG. 3D illustrates one further form of the invention wherein the fitted side covering 82 is fitted onto the box spring 14 rather than mattress 12 and the interior upper edge 58 of the inner layer 54 of the skirt portion is fastened to the side covering along an upper portion thereof in order to provide sufficient room for it to drape downwardly as in the previous embodiments. This embodiment provides greater freedom of access to the mattress for changing the linen thereon. The box spring is shown in FIG. 3D supported on a waterbed type peripheral frame 84 which is recessed interiorly of the outer edges of the box spring so that the fitted side covering 82 can freely engage the lower edge of the box spring as shown.

It is also contemplated that the connection of the inner skirt layer 54 to the fitted side covering 30 at least adjacent the head end of the bed may be made by a zipper connection or other detachable fastening means so that the skirt 50 and top portion 38 may be folded back toward the rear of the bed to a greater extent than otherwise permitted by expansion of the skirt portion alone, to further facilitate entry onto the bed.

Likewise, it is apparent that most all of the stitched or sewn connections in the various embodiments could be replaced by zippers, snaps or other disengageable fastening means if perferred. Generally, the sewn seams are preferred as a light weight permanent fastening means which best eliminates drafts. A zipper or the like may be advantageous for the connection between the skirt and fitted side covering however for easier entry onto the exit from a bed provided with the bed covering of the invention.

Thus there has been shown and described a draped and fitted bed covering which accomplishes at least all of the stated objects.

I claim:

1. A bed covering for a mattress having a head end, a foot end, opposite sides and a top surface, said bed covering comprising, a fitted side covering adapted to overlie the head end, foot end and sides of a mattress and means for fitting said side covering onto a mattress, a top portion adapted to overlie the top surface of the mattress, and having a head edge, a foot edge and opposite side edges, a skirt portion folded along a medial lower edge thereof so as to present a folded lower edge and interior and exterior upper edges, said exterior upper edge of the skirt portion being connected to the top portion along the foot edge and opposite side edges thereof, said interior upper edge of the skirt portion being connected to said fitted side covering, said skirt portion being vertically movable with said top portion relative to said fitted side covering thereby to accommodate the entry of a person between said top portion and a mattress onto which said bed covering is fitted said lower edge of said skirt portion being disposed substantially below the mattress when said top portion lies flat on said top surface of the mattress.

2. The bed covering of claim 1 wherein said interior upper edge of the skirt portion is fastened to a lower portion of said fitted side covering.

3. The bed covering of claim 2 wherein said interior upper edge of the skirt portion is detachably fastened to said fitted side covering.

4. The bed covering of claim 3 wherein a zipper is provided for detachably fastening said interior upper edge of the skirt portion to the fitted side covering.

5. The bed covering of claim 1 wherein said means for fitting said side covering onto a mattress comprises elasticized upper and lower edges of said fitted side covering, said upper and lower edges adapted to be tucked in along the sides and ends both above and below said mattress, said tucked portion defining a central opening through which the mattress and any linen thereon is exposed for supporting a person.

6. The bed covering of claim 1 wherein said means for fitting said side covering onto a mattress includes an elasticized tuck portion along the lower edge thereof adapted to be tucked in along the ends and sides of the mattress.

7. The bed covering of claim 6 wherein said fitted side covering comprises a portion of a fitted sheet.

8. The bed covering of claim 6 further comprising detachable fastening means along the upper edge of said fitted side covering and further comprising a flat sheet having coacting fastening means along the border thereof for attachment to said detachable fastening means.

9. The bed covering of claim 1 wherein said top portion and skirt portion comprise integral parts of a unitary fabric covering.

10. The bed covering of claim 1 further comprising a dust ruffle connected to said fitted side covering along the head edge thereof.

11. In combination, a box spring, means for supporting said box spring in clearance relation from a support surface, a mattress supported on said box spring, said mattress having a head end, foot end, opposite sides and a top surface, and a bed covering comprising, a fitted side covering adapted to overlie and being fitted on the head end, foot end and sides of said box spring, a top portion adapted to overlie the top surface of the mattress, and having a head edge, a foot edge and opposite side edges, a skirt portion folded along a medial lower edge thereof so as to present interior and exterior upper edges, said exterior upper edge of the skirt portion being connected to the top portion along the foot edge and opposite side edges thereof, said interior upper edge of the skirt portion being connected to said fitted side covering, and said skirt portion being vertically movable with said top portion relative to said fitted side covering thereby to accommodate the entry of a person between said top portion and mattress.

12. A bed covering for a mattress having a head end, a foot end, opposite sides and a top surface, said bed covering comprising, a fitted side covering adapted to overlie the head end, foot end and sides of a mattress and means for fitting said side covering onto a mattress, a top portion adapted to overlie the top surface of the mattress, and having a head edge, a foot edge and opposite side edges, a skirt portion folded along a medial lower edge thereof so as to present a folded lower edge and interior and exterior upper edges, said exterior upper edge of the skirt portion being connected to the top portion along the foot edge and opposite side edges thereof, said interior upper edge of the skirt portion being connected to said fitted side covering, said skirt portion being vertically movable with said top portion relative to said fitted side covering thereby to accommodate the entry of a person between said top portion and a mattress onto which said bed covering is fitted, said interior upper edge of the skirt portion being detachably fastened to a lower portion of said fitted side covering.

* * * * *